United States Patent [19]

Perkins

[11] Patent Number: 4,651,681

[45] Date of Patent: Mar. 24, 1987

[54] HEATING SYSTEM USING A LIQUID HEATER AS THE SOURCE OF HEAT

[76] Inventor: Eugene W. Perkins, Rte. 1, Box 1399, Dawsonville, Ga. 30534

[21] Appl. No.: 496,646

[22] Filed: May 20, 1983

Related U.S. Application Data

[63] Continuation-in-part of Ser. No. 311,074, Oct. 13, 1981, Pat. No. 4,424,797.

[51] Int. Cl.[4] ..... F22B 3/06

[52] U.S. Cl. ..... 122/26; 126/247; 237/1 R

[58] Field of Search ..... 122/26; 126/247; 237/1 R; 165/171, 173, 177

[56] References Cited

U.S. PATENT DOCUMENTS

| | | | |
|---|---|---|---|
| 2,646,971 | 7/1953 | Raskin | 165/171 |
| 4,143,639 | 3/1979 | Frenette | 122/26 X |
| 4,256,085 | 3/1981 | Line | 122/26 X |
| 4,277,020 | 7/1981 | Grenier | 122/26 X |
| 4,371,112 | 2/1983 | Tholen | 122/26 X |

FOREIGN PATENT DOCUMENTS

| | | | |
|---|---|---|---|
| 1012613 | 3/1954 | Fed. Rep. of Germany | 165/176 |
| 2942147 | 6/1981 | Fed. Rep. of Germany | 165/171 |
| 738513 | 10/1955 | United Kingdom | 237/69 |
| 2017895 | 10/1979 | United Kingdom | 165/176 |

*Primary Examiner*—Henry Bennett

*Attorney, Agent, or Firm*—Scrivener Clarke Scrivener and Johnson

[57] ABSTRACT

A heating system of the portable, installed or other type in which the heat source is an apparatus in which a body of liquid is heated by friction produced in the liquid by a rotating body immersed in the liquid and the heated liquid is supplied to a heat exchanger, the heating system being made efficient and successful by relations between its parts and by reduction of the time spent in the heater exchanger by the heated liquid.

1 Claim, 1 Drawing Figure

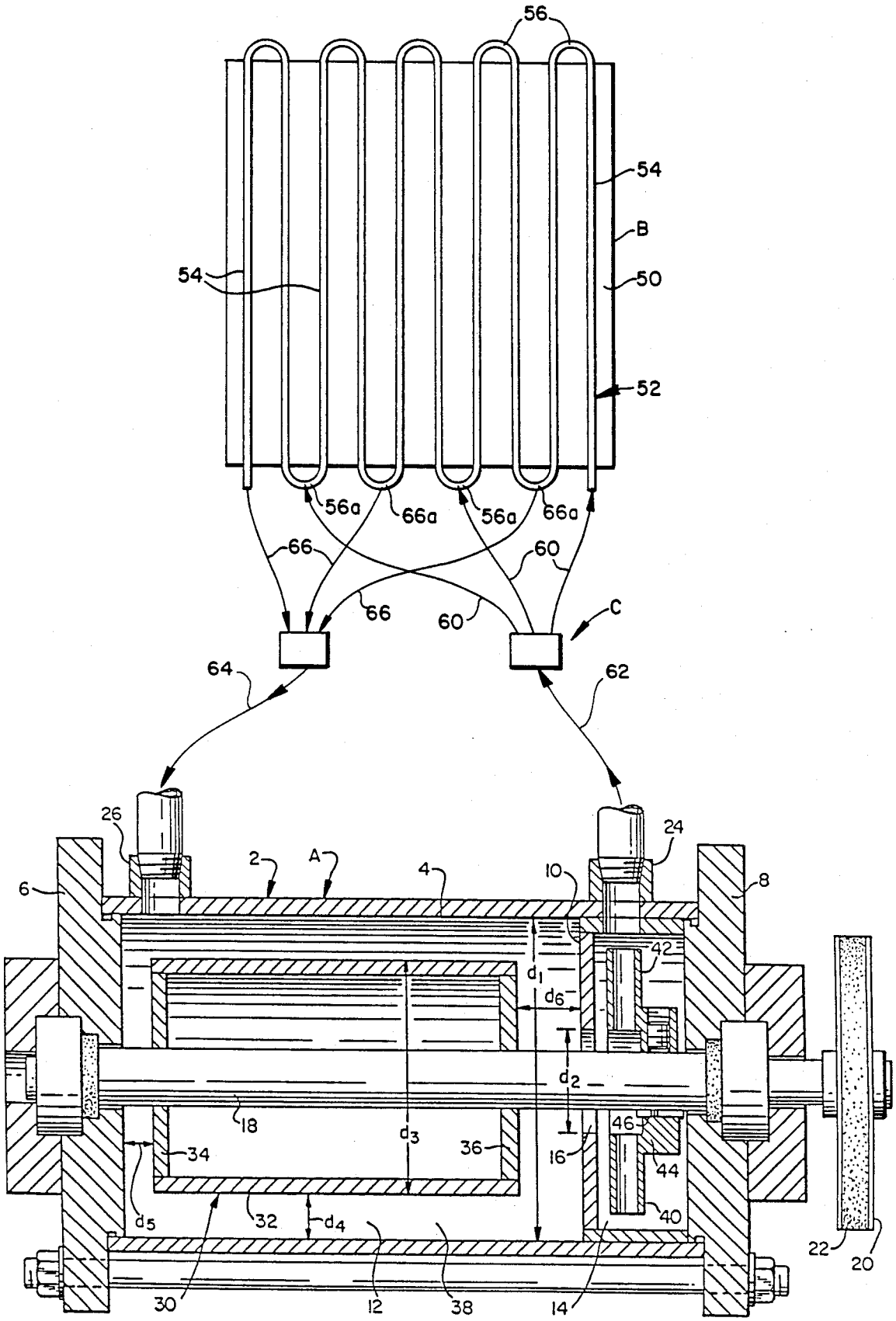
56
54
B
50
52
54
56a
66a
56a
66a
66
60
66
60
C
64
62
26
24
2
A
4
10
8
6
42
d1
d6
d2
18
d3
46
34
36
16
44
40
d5
32
d4
22
20
30
12
38
14

HEATING SYSTEM USING A LIQUID HEATER AS THE SOURCE OF HEAT

RELATION TO OTHER CASES

This application is a continuation-in-part of my copending application Ser. No. 311,074, filed Oct. 13, 1981, for Heating Device, now U.S. Pat. No. 4,424,797.

SUMMARY OF THE INVENTION

A heating system, which may be portable or installed in a residential or other type of building, has as its source of heat a liquid heater in which a body is rotated within a closed chamber containing a liquid which, in turn, is supplied through tubing to a heat exchanger external to the source of heat, which is of the type in which heated fluid flows through a tube having a plurality of parallel linear sections connected by bends. The heated liquid is supplied by the source through a plurality of separate tubes leading to alternate bends of the heat exchanger tubing, and the other bends are connected through a plurality of other separate tubes to the inlet of the liquid heater, whereby heated liquid passes through only a part of the entire heat exchanger and thereby retains a greater part of its heat.

BRIEF DESCRIPTION OF THE DRAWINGS

The single FIGURE of the drawings is a view of the heating system provided by the invention.

DESCRIPTION OF THE PREFERRED EMBODIMENT OF THE INVENTION

The preferred embodiment of the heating system provided by the invention is illustrated in the drawings and comprises a liquid heating unit A, a heat exchanger B, and tubing C, which provides a circulating system for carrying heated liquid from the liquid heating unit to the heat exchanger, where it loses heat, and back to the heating unit for re-heating.

The liquid heating unit A comprises a housing 2 having an internal chamber which is bounded by cylindrical surface 4, having diameter d1 and end walls 6, 8. A partition 10 divides the chamber into a rotor chamber 12 and a pump chamber 14, and has a central opening 16 of diameter d2. A shaft 18 is rotatably mounted in the end walls and extends concentrically through the rotor chamber and the pump chamber and passes through the opening in the partition. Means are provided for rotating the shaft and may take the form of a pulley 20 carried by the shaft outside the housing and connected to be driven by a motor (not shown) and belt 22. The pump chamber has an outlet port 24 and the rotor chamber has an inlet port 26 to which are connected parts of the circulating tube system C.

Within the rotor chamber there is mounted on shaft 18 a rotor body 30 having a cylindrical surface 32 of diameter d3 and end walls 34, 36. The rotor surface 32 is concentric with the cylindrical housing surface 4 and spaced inwardly from it by radial distance d4, leaving an annular space 38 within the housing and surrounding the rotor. The end walls 34, 36 of the rotor are parallel to, and spaced inwardly from, the housing end wall 6 and partition 10 and are spaced inwardly from them by distances d5 and d6, respectively.

An impeller-type pump 40 is mounted on shaft 18 within the pump chamber and has radial hollow vanes 42 surrounding a central hub 44 having an inlet recess 46 which faces the central opening in partition 10.

The heat exchanger B is of conventional structure and comprises a screen 50 supporting a tube 52 which in accordance with known practice is formed into a plurality of parallel sections 54 connected by bends 56 to provide in conventional practice, a continuous conduit within the screen for the passage of heated liquid.

The invention provides means for reducing dissipation of heat from the liquid in the heat exchanger. In distinction to the conventional heat exchanger in which the liquid passes through the entire exchanger tubing all liquid delivered to the tubing of the heat exchanger in accordance with the invention passes through only a small part of the entire tubing of the exchanger, thereby reducing dissipation of heat from the liquid and returning the heated liquid to the heating unit at a higher temperature than if, as under conventional practice, the liquid passed through the entire tubing of the heat exhanger.

The means for providing this result at the heat exchanger comprises a plurality of tubes 60 which branch outwardly from the tube 62 which connects the heat exchanger to the outlet passage 24 of the heating unit, and which are connected to alternate bends **56*a* of the complete heat exchanger tubing. In addition, the tube 64 which leads to the inlet passage 26 of the heating unit is connected through a plurality of branch tubes 66 which are connected to the bends 66*a* of the heat exchange tubing between the bends 56*a*** to which the inlet tubes are connected.

Because of these connections of the inlet and outlet passages of the heater unit to the heat exchanger tubing heated liquid from the heater unit is within the heat exchanger for a shorter length of time than is the case in which the liquid passes through the entire heat exchanger tubing system, thereby returning to the heating unit liquid with a greater heat content. It will be understood that while, for the purpose of this description of the preferred embodiment of the invention, the inlet and outlet connections are made to alternate bends of the heat exchanger tubing the connections may be made to bends or parts of the tubing spaced more than alternately if it is desired to increase the heat loss by the liquid while in the heat exchanger.

The incorporation into a heating system of the features of this invention results in the maintenance of a sufficiently high percentage of the heat content of the liquid to cause a "flywheel" effect which permits successful use of the liquid heater of the described type as the source of heat of a complete heating system.

I claim:

1. A space heating system comprising (a) a source of heated liquid comprising a chamber containing a liquid, a body within the chamber which is rotated to heat the liquid, and outlet and inlet passages communicating with the chamber, (b) a heat exchanger external to the source of heated liquid comprising a unitary continuous tubing formed into a plurality of parallel connected linear sections, (c) the outlet passage of the source of heated liquid being connected through a plurality of separate tubes to alternate sections of the heat exchanger tubing, and the inlet passage of the source of heated liquid being connected through a plurality of separate tubes to the other alternate sections of the heat exchanger tubing, whereby heated liquid passing from the outlet passage to the inlet passage of the source of heated liquid passes through only a part of the heat exchanger tubing.

* * * * *